United States Patent [19]

Snead et al.

[11] Patent Number: 4,925,356

[45] Date of Patent: May 15, 1990

[54] SELF-UNLOADING TRAIN FOR BULK COMMODITIES

[76] Inventors: Edwin D. Snead; William B. Snead, both of P.O. Box 1000, Georgetown, Tex. 78626

[21] Appl. No.: 296,346

[22] Filed: Jan. 9, 1989

Related U.S. Application Data

[63] Continuation of Ser. No. 47,005, May 6, 1987, abandoned, which is a continuation-in-part of Ser. No. 741,695, Jun. 6, 1985, abandoned.

[51] Int. Cl.[5] ..... B61D 7/00; B65G 21/00; B65G 67/24

[52] U.S. Cl. ..... 414/339; 414/505; 414/519; 414/528; 414/786

[58] Field of Search ..... 414/339, 786, 343, 352, 414/353, 519, 520, 528, 502–505, 527; 198/311, 303, 816.2, 825, 829, 830, 317, 318; 104/2; 105/239

[56] References Cited

U.S. PATENT DOCUMENTS

| | | | |
|---|---|---|---|
| 2,805,759 | 9/1957 | Manceau | 198/317 X |
| 2,971,631 | 2/1961 | Gray | 198/303 X |
| 2,989,930 | 6/1961 | Flowers | 105/239 |
| 3,126,083 | 3/1964 | Hollyday | 414/505 X |
| 3,167,193 | 1/1965 | Klosk | 414/339 X |
| 3,300,023 | 1/1967 | Creutzmann et al. | 198/825 X |
| 3,581,874 | 6/1971 | Keith | 198/317 |
| 3,986,708 | 10/1976 | Heltzel et al. | 414/502 X |
| 4,117,699 | 10/1978 | Renaut | 198/813 X |
| 4,173,422 | 11/1979 | Baker et al. | 414/520 X |

FOREIGN PATENT DOCUMENTS

| | | | |
|---|---|---|---|
| 399461 | 7/1924 | Fed. Rep. of Germany | 414/339 |
| 2117302 | 10/1972 | Fed. Rep. of Germany | 198/813 |
| 2451518 | 5/1976 | Fed. Rep. of Germany | 414/527 |
| 1166744 | 11/1958 | France | 414/528 |
| 295274 | 10/1951 | Switzerland | 198/829 |
| 457678 | 12/1936 | United Kingdom | 198/825 |
| 616929 | 1/1949 | United Kingdom | 414/528 |
| 730300 | 5/1955 | United Kingdom | 414/528 |
| 857705 | 1/1961 | United Kingdom | 414/528 |
| 881864 | 11/1961 | United Kingdom | 414/528 |
| 2127377 | 4/1984 | United Kingdom | 414/528 |

*Primary Examiner*—David A. Bucci
*Attorney, Agent, or Firm*—Harrison & Egbert

[57] ABSTRACT

A unit train consisting of a plurality of hopper cars and a multi-purpose trailer car. The hoppers cars have one or more hoppers each having a bottom discharge opening and a controllable gate. An endless belt conveyor traverses the length of the train including a portion of the trailer car, and underlies the hopper discharge gates so that the hoppers may be emptied sequentially onto the train conveyor to unload the entire train. The trailer car includes a lift portion of the train conveyor to elevate the material for discharge onto a transfer conveyor carried on the trailer car. The elongated transfer conveyor is pivotally mounted at the receiving end to be swung laterally to discharge the material received from the train conveyor at some selected point relative to the trailer car. The trailer car may include the power systems and control systems for operating the conveyors and the hopper gates. The train is self-unloading by depositing the train load in a window alongside the track while the train is moving slowly. For unloading the train in a stationary position, the transfer conveyor may deposit the material onto a portable stacking conveyor which may then deposit the entire train load in one or more stock piles which may be 30 feet high and located some distance from the track.

27 Claims, 8 Drawing Sheets

SELF-UNLOADING TRAIN FOR BULK COMMODITIES

RELATED APPLICATIONS

This application is a continuation of U.S. patent application Ser. No. 07/047,005, filed on May 6, 1987, now abandoned, which is a continuation-in-part of U.S. patent application Ser. No. 06/741.695, filed June 6, 1985, now abandoned.

TECHNICAL FIELD

The present invention relates to a train for the transportation of bulk commodities. More particularly, the present invention relates to trains having onboard facilities for the unloading of bulk commodities. The present invention also relates to a method for rail transport of bulk commodities and for the unloading of such commodities from the rail transport.

BACKGROUND ART

Rail transportation is generally recognized as being more economical than truck transportation for bulk commodities such as aggregates. Large quantities of such commodities can be moved by a small crew at low cost. However, rail transportation frequently loses out in competitive situations because of the cost of unloading, stock piling, and delivering the commodity to the ultimate destination.

Even though large quantities of bulk material can be transported at low cost from one terminal to another, the burden is placed on the unloading facility to maintain the economics of this method of transportation for the purchaser of the commodity. Even if the unloading is slow, and the train is therefore delayed for a substantial period of time for the unloading to be accomplished, there is an added investment cost per ton handled for the use of the railroad equipment. One problem, in this regard, is that rail transportation is a twenty-four hour operation while many of the industries it serves operate only during daylight hours. Often a train makes good speed from origin to destination, only to be delayed several hours waiting to be unloaded. Each hour of delay adds to the transportation cost as much as an additional twenty-five to thirty miles of haul.

As an example of the efficiency of rail transport for bulk commodities, a train with a two-man crew pulling 1600 net tons at fifty-five miles per hour would be producing thirty-two times as many ton-miles per hour as a dump truck driver hauling twenty-five tons at fifty-five miles per hour.

Another problem affecting the efficiency of rail transporatation for bulk commodities is that, under current methods, the quick unloading of a commodity train requires high capacity equipment and facilities which are idle most of the time. Such high-capacity equipment and facilities are expensive and add significantly to the investment cost per ton handled.

It is important for rail transportation of bulk commodities to offer ease of unloading and ease of transportation. This is particularly the case where aggregates and bulk material having a particle size ratio of over six are involved. (A particle size ratio of six means that the largest particles are no more than six times the size of the smallest particles.) Also, the amount of load that can be carried by the rail transportation system is a function of the center of gravity of the load. If the center of gravity of the load is too high, then less material can be carried. A high center of gravity will enhance the risk of derailing and/or toppling of hopper cars. Additionally, hopper cars that have relatively shallow walls and relatively small discharge openings will create difficulties when the material is desired to be discharged. With certain types of materials, the shallow walls will cause a "bridging" effect with the material within the hopper car. Thus, it becomes difficult to unload the hopper car when the hopper car reaches the destination site.

The following are some of the methods which are currently used for the unloading of bulk materials from trains.

Bottom dumping hopper cars are equipped with automatic doors that are opened automatically as the cars move over a pit, where the pit facility includes a feeder and a conveyor. Either a pit or an elevated trestle is required for this method, so that this method is ruled out at many locations. Obviously, the providing of a pit or trestle facility with associated conveyor systems is expensive.

Another method involves the use of rotary car dumpers; and these are commonly used for unloading coal at electric generating plants. Again, the equipment for unloading the cars is highly specialized and expensive.

Side dumping cars have been used for many years, but cannot be dumped on level ground. They require an elevated track on a built-up embankment, for example, so that the dumped material will flow over the side of the embankment and not flow back over the track.

Finally, backhoes or other unloading equipment are used to unload standard gondola cars. These methods are generally slow, promoting the delay problems mentioned above.

West German Patent Specification No. 24 51 518 describes a railway goods train with an automatic material unloader. This material unloader includes a conveyor belt located within the hopper cars to assist in the discharge of material. This system includes a conveyor belt that is located so as to create a high center of gravity for the hopper car. In particular, the conveyor belt has a return run mounted above the car platform that has troughing idlers mounted in a conventional fashion and spaced significantly from the return idlers. Additionally, this German Specification shows a hopper car having relatively shallow walls and small discharge openings. This is suitable for the transportation of sand or bulk materials having a a particle size ratio of six or less. However, such a configuration of hopper car is not appropriate for the transportation of aggregates or material having large particle size ratios.

To take maximum advantage of the efficiencies of rail transportation for aggregate materials, a special type of train is needed to deliver bulk commodities on any track, at any time of the day or night, with no labor required other than the train crew. Such a train would make optimum use of labor while providing incentive wages for the crew, and thereby reduce overall labor costs.

A self-unloading train which overcomes many of the above-discussed disadvantages of rail transportation for aggregate materials may be a "unit train" consisting of a plurality of hopper cars and a trailer car, the unit train to be pulled by a conventional locomotive. Each of the hopper cars may include several hoppers having bottom discharge openings and associated gates for discharging onto an endless belt conveyor which runs the entire length of the train. These hopper cars would have walls that were inclined at relatively steep angles and have relatively large bottom discharge openings. The trailer car would include a transfer conveyor which receives the material from the train conveyor, and is movable on the trailer car to transfer the material to a selected point relative to the train.

With the unit train moving along a straight section of track, the material may be deposited in a window along the track by the transfer conveyor. Alternatively, the unit train may be unloaded while stationary, with the tansfer conveyor discharging onto a portable stacking conveyor, for example, which will enable the deposit of the material in piles thirty feet high, at least forty feet away from the track, for example.

An object of this invention is to provide improved equipment and methods for the rail transport and unloading of bulk materials, such as aggregate.

Another object of this invention is to provide such improved equipment and methods whereby the unloading may be accomplished by the train crew at any time of the day or night, thereby eliminating idle time of the train equipment while waiting for the opening of an unloading facility or while waiting for the arrival of material-receiving equipment or vehicles.

A further object of this invention is to provide such equipment and methods wherein the unloading does not require highly specialized and expensive unloading facilities or equipment.

Still another object of this invention is to provide such apparatus and methods wherein the unloading of the train may be accomplished efficiently in a very short time.

Another object of the invention is to provide such equipment and methods to minimize the expense of unloading bulk materials from a transport train.

Another object of this invention is to provide such equipment and methods wherein the equipment includes self-unloading apparatus.

Another object of this invention is to provide such equipment and methods so as to provide for a low center of gravity for the hopper cars of the train.

It is still a further object of the present invention to provide such equipment that enhances the ability to unload aggregate-type materials.

A still further object of this invention is to provide such equipment and methods wherein the equipment is a unit train having a train length conveyor.

Still another object of this invention is to provide such equipment and methods which take advantage of the efficiency of rail transportation by eliminating the need for a specialized unloading facility.

These and other objects and advantages of this invention will become apparent from the reading of the attached specification and appended claims.

BRIEF DESCRIPTION OF THE INVENTION

The present invention is a self-unloading train for the transfer of bulk materials that comprises a plurality of hopper cars, a train conveyor, and a gating system. The plurality of hopper cars are coupled together to form a train. Each hopper car has at least one hopper having walls inclined at shallow angles to the vertical and a bottom discharge opening having a width at least fifty percent of the distance between the wheels of the hopper cars. The train conveyor comprises an endless belt supported on the cars and underlying each of the hopper discharge openings. This endless belt receives the material discharged from the hopper discharge openings. The train conveyor extends the length of the plurality of hoppers cars. This train conveyor has a width that is substantially greater that the width of the discharge openings. The gating systems are operable selectively so as to discharge material from the hopper onto the train conveyor.

The present invention includes gate members that comprise clam shell-type gates pivoted about the axis parallel to the train conveyor. These gates assist in controlling the flow of material onto the train conveyor.

A trailer car is included with the self-unloading train of the present invention. The train conveyer extends to the trailer car. This trailer car supports a lift portion of the train conveyer at its discharge end sufficiently high to discharge the material to a transfer conveyer. This transfer conveyer is mounted on the trailer car so as to receive material from the train conveyer and to discharge the material at selected points surrounding the trailer car.

Each of the hopper cars has a center sill. The return run of the conveyer belt is supported by split return idlers disposed along each side of the center sills. The supply run of the conveyor belt is supported by catenary troughing idlers disposed immediately above the return run.

The present invention further includes a driving system for the train conveyor and the transfer conveyor mounted on the trailer car. This driving system includes electric drive motors for the conveyor, a generator for providing electric power to the drive motors, and an internal combustion engine for driving the generator.

The method of the present invention comprises the following:

(1) loading bulk material onto a train having a plurality of hopper cars; (2) forming the hoppers of the hopper cars with walls inclined at a shallow angle from the vertical and a bottom discharge opening having a width at least fifty percent of the distance between the wheels of the hopper cars; (3) discharging the material from the hoppers by discharge gates associated with the discharge opening; (4) discharging the material from the hoppers onto a train conveyor underlying the hoppers and running the length of the coupled hopper cars; and (5) forming the train conveyor as an endless belt conveyor having a width substantially greater the the width of the discharge openings. This method further includes the step of controlling the flow of material from the hoppers by power actuated discharge gates. These discharge gates are operated sequentially.

This method further the steps of: (1) forming the hopper cars to include a center sill; (2) supporting the return run of the conveyor belt by using split return idlers disposed on opposite sides of the center sill; and (3) supporting the troughing idlers of the conveyor in a catenary fashion to support the supply run of the conveyor belt immediately above the return run of the belt. The transfer conveyor can be swung laterally relative to the train conveyor to deposit the material at selected points. The material may be discharged by moving the train during the discharing process so as to produce windrows of material paralleling the train track. Alternatively, the material from the transfer conveyor can be discharged into a stacking conveyor so as to product a large pile of material distant from the train.

DETAILED DESCRIPTION OF THE INVENTION

Figure 1:
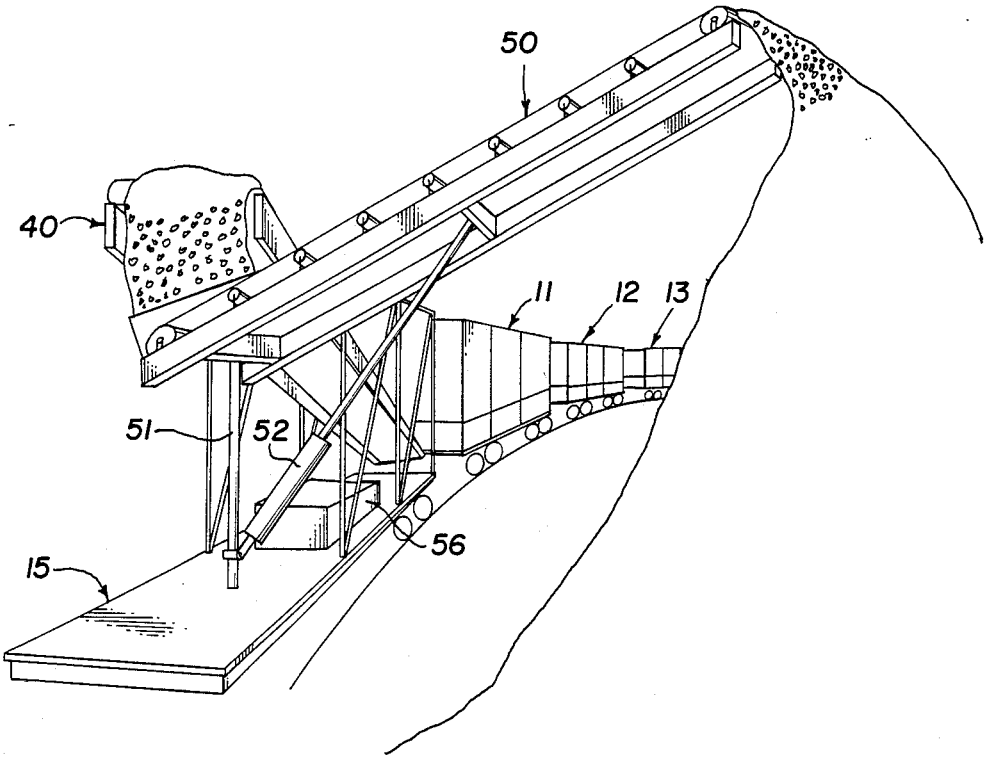
FIG. 1 is a diagrammatic perspective view of a self-unloading train according to the present invention, including hopper cars and a trailer car.

FIG. 1 is a diagrammatic perspective view illustrating the rear end of a self-unloading train in accordance with the preferred embodiment of the present invention. FIG. 1 illustrates three hopper cars 11, 12 and 13, and a trailer car 15. Trailer car 15 is the last, or rearmost, car of the train.

The train, according to the invention, may be referred to as a "unit train", in the sense that the cars of the train are permanently coupled together and would not be uncoupled unless it was necessary to move one of the cars to a service facility. A self-unloading train, according to the invention, is particularly suitable for the transport of aggregates. By way of example, a train according to the invention may include ten hopper cars, each hopper having a net capacity of eighty tons of aggregate, and an associated trailer car. Such train, then, would have the capacity to haul 800 tons of aggregate; and such train would be pulled by one conventional locomotive. Further, by way of example, each hopper car may include three separate hoppers, each having a bottom discharge opening and an associated discharge gate. The hopper cars are designed to support an endless belt train conveyor, which traverses the length of the train including the hopper cars and a portion of the trailer cars; and this train conveyor underlies the discharge gates of the several hoppers.

Figure 2:
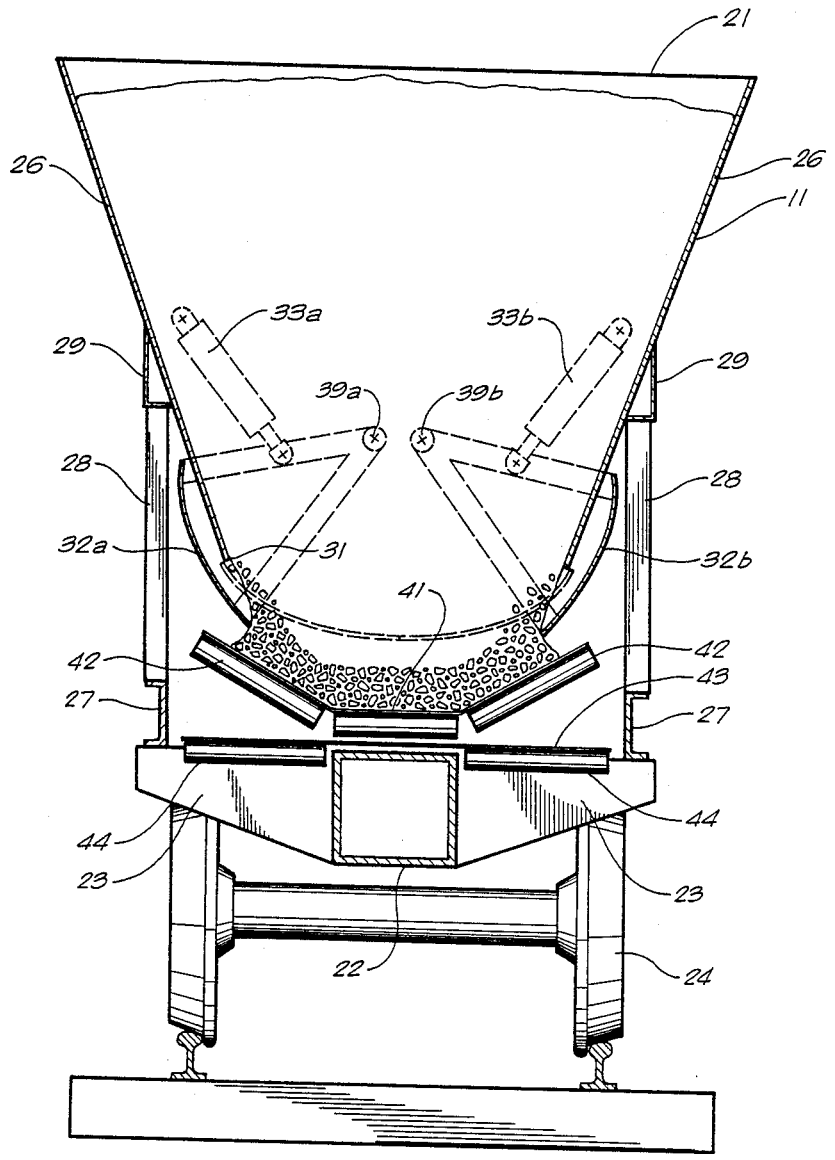
FIG. 2 is a diagrammatic cross-sectional view of a typical hopper car.
Figure 3:
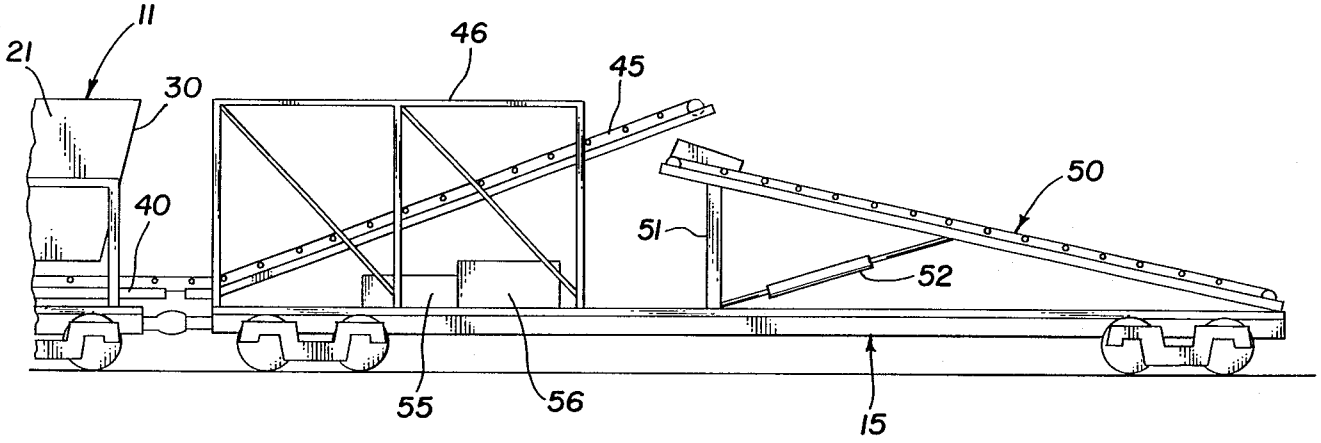
FIG. 3 is a diagrammatic side elevational view of the trailer car illustrated in FIG. 1.

FIG. 2 is diagrammatic cross-sectional view of hopper 11, the section being taken through one of the hoppers 21 of the hopper car. As can be seen in FIG. 2, the hopper car 11 has a main frame having a center sill 22 and side beam members 23 which would be supported on trucks 24 in a conventional manner. While this particular form of railcar structure is illustrated, it will be understood that the hopper car may be constructed using other known techniques where the center sill is eliminated. The hopper body 21 is generally rectangular, as viewed from the top. Hopper body 21 includes planar side walls 26 and corresponding planar end walls. As seen in FIGS. 2 and 3, the hopper walls 26 are inclined at shallow angles to the vertical so as to effect complete discharge of all material by gravity. The side walls 26 are inclined by at least seventy degrees from the horizontal. The end walls 30 are even more narrowly vertical. The hopper is supported by means of longitudinal channel stringers 27 supported at the outer ends of the side beams 23, in turn supporting vertical posts 28 which bear on angle brackets 29 suitably secured to the side walls 26 of the hopper.

The bottom discharge opening 31 of the hopper is quite wide and quite long. The width is at least fifty percent of the distance between the hopper car wheels, as illustrated in FIG. 2. The length of the bottom discharge opening 31 constitutes a substantial portion of the longitudinal top dimension of the hopper, as illustrated in FIG. 3. The discharge opening 31 is closed by a suitable clam shell gate consisting of a pair of coacting gate members **32*a* and 32*b* pivotally mounted for movement between an open position, and a closed position as illustrated in broken lines in FIG. 2. The pivot axes 39*a* and 39*b* for the gate members are parallel to the train conveyor. The hopper 21 is supported sufficiently high relative to the hopper car frame to allow for the support of the endless belt conveyor 40**, as described hereinafter.

The conveyor belt has a width substantially greater than that of the hopper discharge openings 31. Specifically, the conveyor belt has a width approximately 33% greater than the hopper discharge opening 31. The supply belt 41, which is the upper run of the endless belt conveyor 40 is supported in the form of a trough by troughing idlers 42. This trough confronts the discharge opening 31 of the several hoppers. The return belt 43, which is the return portion of the endless belt conveyor 40, is supported immediately under the supply belt in a flat condition by return idlers 44.

As seen in FIG. 2, the return idlers are split ilders mounted on either side of the car center sill 22 to support the return run 43 as close as possible to the upper surface of the center sill. The troughing idlers 42 are necessarily supported in catenary fashion to enable the positioning of the supply run 41 as close as possible to the return run. With this belt support arrangement, the entire hopper car will have the lowest possible center of gravity.

Figure 6:
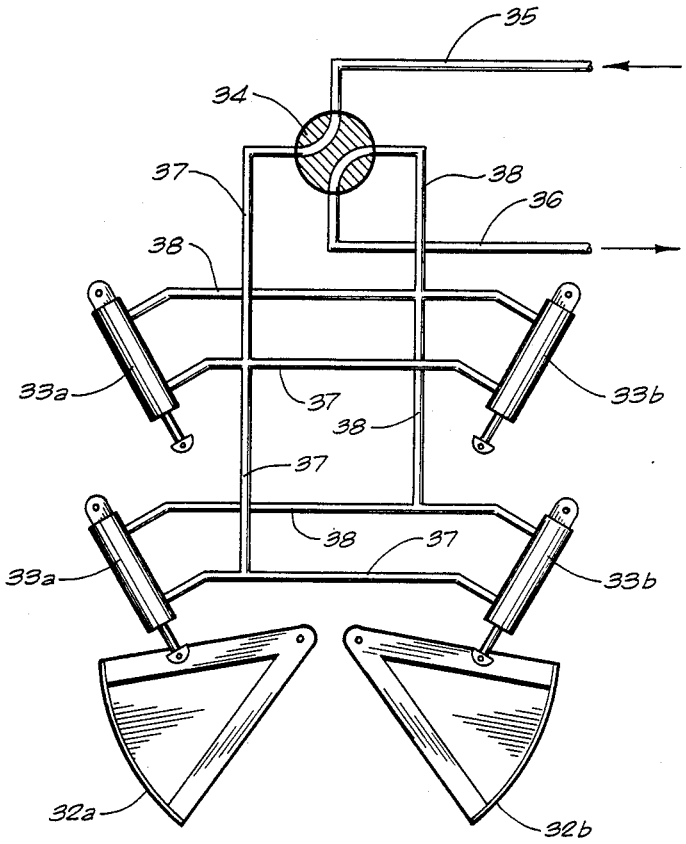
FIG. 6 is diagrammatic illustration of the hydraulic control system for the claim-shell gate members of one hopper.

As can be seen in FIGS. 2 and 6, the clam shell gate members **32*a* and 32*b* are preferably operated between the closed and opened positions by power means, such as hydraulic cylinders 33*a* and 33*b***, which may be operated under the control of suitable control valves to be described subsequently.

As mentioned, the train conveyor 40 traverses the entire length of the hopper car portion of the unit train and a portion of the length of the trailer car 15, as best seen in FIG. 3. The adjacent cars of the unit train have suitable support structures for supporting the train conveyor over the car couplers.

The trailer car 15 is a multi-purpose car and, as best seen in FIG. 3, may consist of a conventional flat-bed car carrying certain structures to be described. The portion of the train conveyor 40 which is carried on the trailer car, is a lift portion 45 which elevates the conveyed material for discharge into a transfer conveyor 50. This lift portion 45 is supported by a suitable frame structure 46 of the trailer car.

The transfer conveyor 50 is an elongated endless belt conveyor, having a length of about 30 feet, for example, which is carried at the rearward end of the trailer car 15. The forward end of the transfer conveyor is mounted on a post 51 underlying the rearward end of the train conveyor 40, with the transfer conveyor being supported to rotate relative to the vertical axis of the post 51 so as to position its rearward discharge end at any desired point. During transit, the transfer conveyor is carried, as illustrated in FIG. 3, in longitudinal alignment with the trailer car. The transfer conveyor is also pivotable, relative to the post 51, about a horizontal transverse axis, so that the rearward end of the conveyor may be elevated as desired; and this is accomplished by means of a hydraulic lift cylinder 52. The transfer conveyor is preferably provided with hydraulically powered means for rotating the conveyor relative to the axis of post 51. In this manner, the discharge end of the transfer conveyor can be positioned where desired to discharge the material from the train conveyor 40 into other transport vehicles, onto another conveyor, onto piles adjacent to the track, or onto the track behind the trailer car.

The trailer car 15 may also carry power generating apparatus for operating the conveyor system described. The train conveyor 40 and the transfer conveyor 50 are preferably driven by suitable electric motors; and the power for these motors may be generated by a suitable electric generator 55 driven by a suitable internal combustion engine 56 such as a diesel engine. The generator 55 may also provide power for auxiliary apparatus such as a portable stacking conveyor, to be described.

The clam shell gate members **32*a* and 32*b* for the hoppers will be quite long and heavy, the length being somewhat less than the length of the hopper top. Each gate member is preferably operated by a pair of double-acting hydraulic cylinders 33*a* and 33*b* mounted at opposite ends of the hopper as seen in FIG. 2. The four cylinders 33*a* and 33*b* would preferably be controlled simultaneously by a single hydraulic valve 34** which may be a manual valve or may be a solenoid valve, for example.

FIG. 6 of the drawings illustrates diagrammatically the above-described controlled system including a pair of double-acting hydraulic cylinders **33*a* for operating gate member 32*a* and a pair of double-acting hydraulic cylinders 33*b* for operating the gate member 32*b*. A four-way hydraulic control valve 34 is connected to the hydraulic system by means of a supply line 35 and a return line 36. The control valve 34 is shiftable between an "opening" position, in which the supply line 35 is connected to the feed line 37 and the return line 36 is connected to the feed lines 38 and a "closing" position in which the supply line 35 is connected to the feed lines 38 and the return line 36 is connected to the feed lines 37. In the "opening" position of the control 34, illustrated in FIG. 6, high pressure hydraulic fluid is supplied to the "opening" ends of the hydraulic cylinders 33*a* and 33*b* to effect the opening of the gate members 32*a* and 32*b* and in the "closing" position of the control valve 34**, the high pressure fluid is fed to the "closing" ends of the hydraulic cylinders to effect the closing of the gate members.

High pressure hydraulic fluid for the operation of these gates 32 would be supplied from the trailer car 15 which would include a suitable electric motor driven hydraulic pump. The electric motor would receive its energy from the above-mentioned generator 55. The controls for the hopper gates should be preferably located at the side of the hopper car in order to be conveniently actuated by a crew member. The controls so located would either be manually operable hydraulic valves, or electric switch controls for operating the solenoid actuated valves.

Preferably, the hoppers would be emptied in sequence beginning with the hopper nearest the trailer car. It is desirable that the hopper gates be operated under the manual and visual control of a crew member to assure that one hopper is completely empty before the gates of the succeeding hopper are opened. Where the load is being dumped in a window, this operator may also assist in controlling the speed of the train by signaling the locomotive engineer to assure the efficient stacking of the window.

The trailer car 15 may also include a suitable control panel or station for the operation and control of the several above-described components including the generator 55, the generator driving engine 56, the motors for the train conveyor 40 and the transfer conveyor 50, the hydraulic mechanisms for both rotating and changing the height of the transfer conveyor, and possibly the mechanism for controlling the tension on the train conveyor 40.

Figure 7:
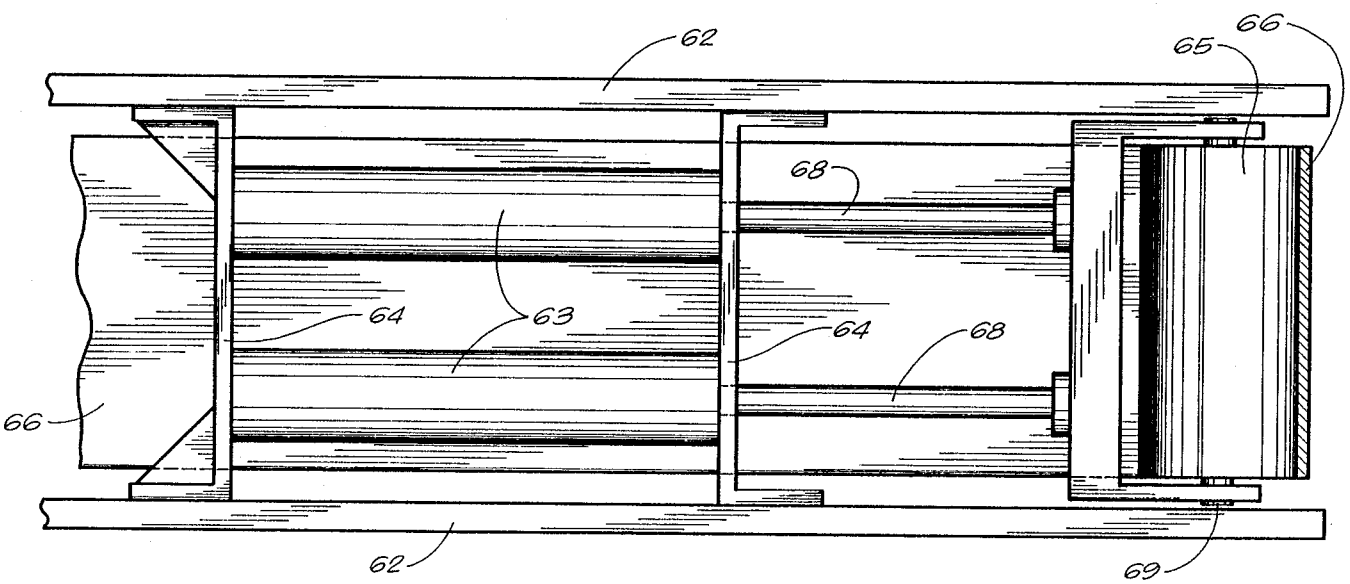
FIG. 7 is a diagrammatic illustration of a belt-tensioning mechanism for the train conveyor.

For the operation of the train conveyor 40, the train must be on a straight section of track, since the conveyor belt cannot accommodate any curves during use. During such use, the conveyor must be appropriately tensioned; and this may be accomplished by a suitable hydraulically controlled system which is associated with the lift portion 45 of the conveyor carried on the trailer car 15. This belt tensioning system may be conventional and a typical system is illustrated diagrammatically in FIG. 7. As seen in FIG. 7, the structure for the conveyor 40 may include side rails 62 for supporting the troughing and return idlers; and these rails also support a pair of hydraulic cylinder units 63 by means of brackets 64. The head (or tail) pulley 65 for the belt 66 is rotatably supported in a yoke 69, which is mounted on the piston rods 68 of the dydraulic cylinder units 63. It will be seen that extension of the piston rods 68 of the hydraulic cylinder units will cause the belt 66 to be tensioned, and that retraction of the piston rods will relax the tension and create slack in the belt.

During transit of the train, some slack must be imparted to the train conveyor to allow the belt to flex at the coupling points and enable the train to negotiate curves without damage to the belt. The control for the belt tensioning system may also preferably be included in the above-mentioned control panel carried on the trailer car.

Figure 4:
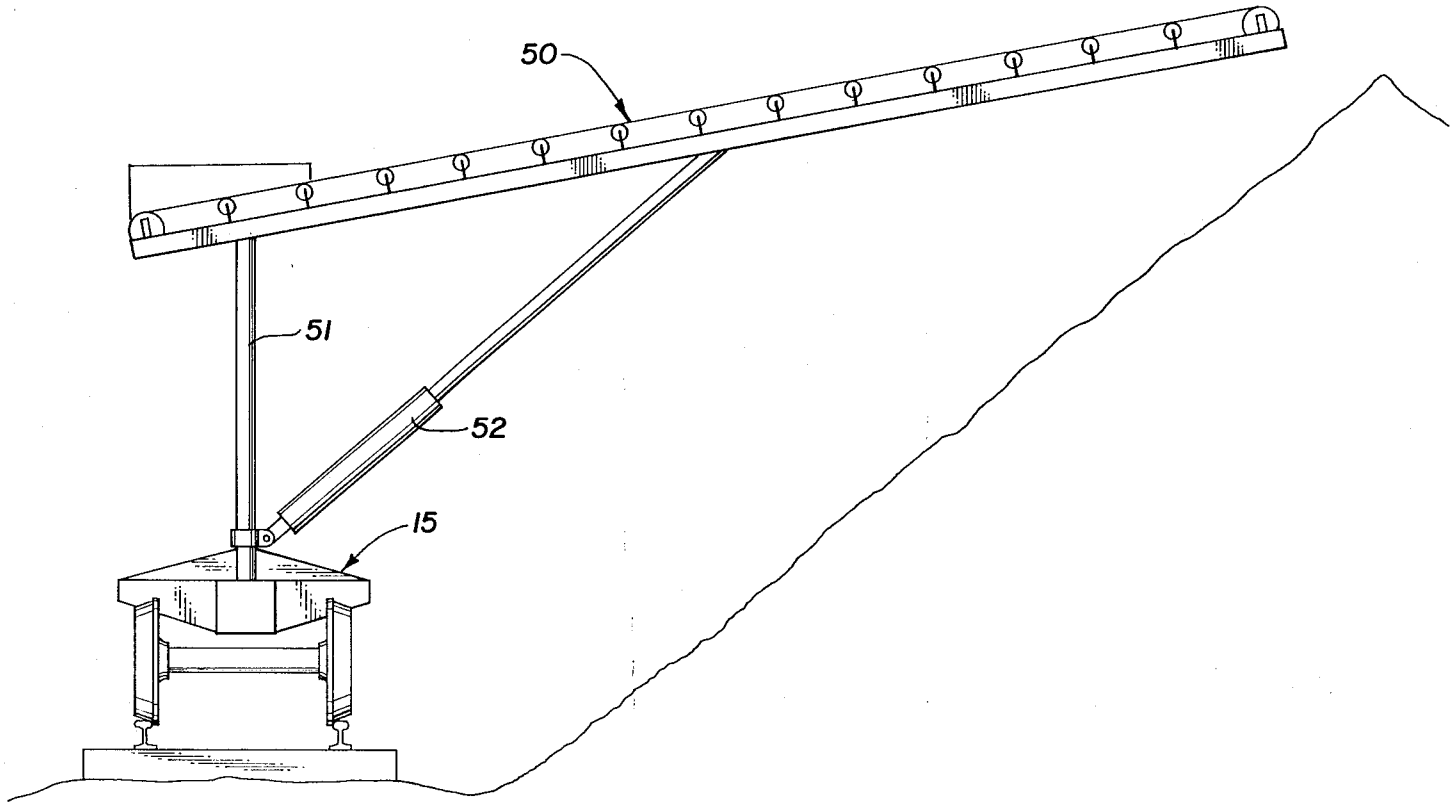
FIG. 4 is a diagrammatic end view of the trailer car and associated transfer conveyor illustrated in FIGS. 1 and 3, with portions of the trailer car structure omitted and illustrating one unloading method.

FIG. 4 of the drawings is a diagrammatic end view of the trailer car, omitting certain structures of the trailer car but illustrating the transfer conveyor 50 in position to deposit the bulk material into a window alongside the track. The window might have a height of ten feet, for example, and the apex must be sufficiently removed from the track to prevent the material from running onto the track. For this operation, also illustrated in FIG. 1, the material may be deposited in the window while the train is moving; and therefore the stretch of straight track must be sufficiently long to allow the train to move a sufficient distance to unload the entired load. For this operation, the hopper gates might be operated in sequence starting from the rear of the train to unload the entire train. It is believed that for this operation, the train would have an unloading rate of one thousand tons per hour, so that an entire eight hundred ton train load can be deposited in a window alongside the track in approximately forty-five minutes.

Figure 5:
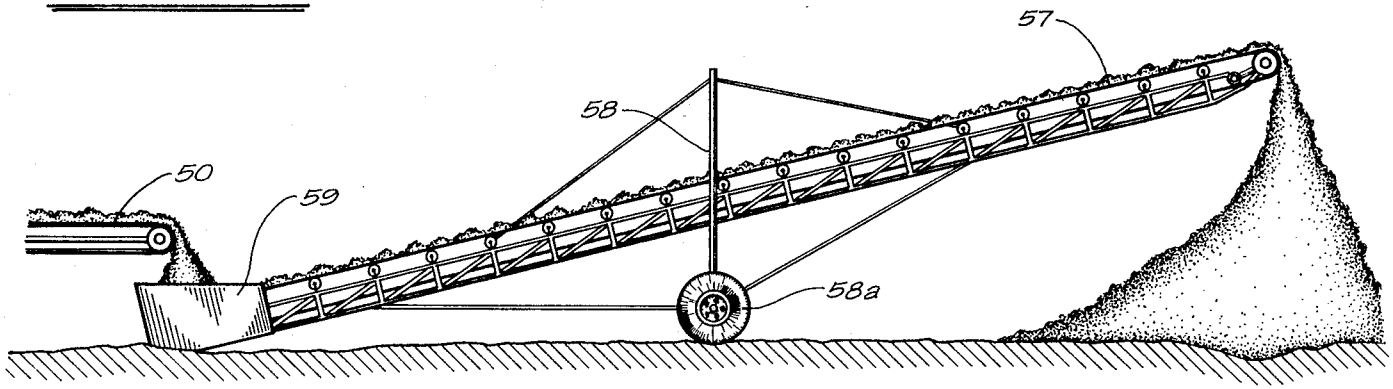
FIG. 5 is a diagrammatic side elevational view of a portable stacking conveyor used in association with the transfer conveyor of the trailer car, and illustrating another unloading method.

FIG. 5 of the drawing illustrates another method for unloading the train of the invention, which may be accomplished while the train is stationary. This method involves the use of a portable stacking conveyor 57. The conveyor 57 is an elongated endless belt conveyor having a support frame 58 including support wheels 58*a* intermediate its ends, and having a receiving box 59 at its receiving end. This conveyor may be powered by a suitable electric motor; and may be connected to the above-described generating system of the trailer car 15. Conceivably, such portable stacking conveyor could be carried with the self-unloading train of the invention; but more practically it would be transported to the unloading site by truck. Such portable stacking conveyor may be positioned relative to the trailer car to enable the stacking of an entire train load, for example, into a pile thirty feet high and forty feet away from the track. For a larger train load, adjacent piles may be made by moving the portable stacking conveyor.

Figure 8:
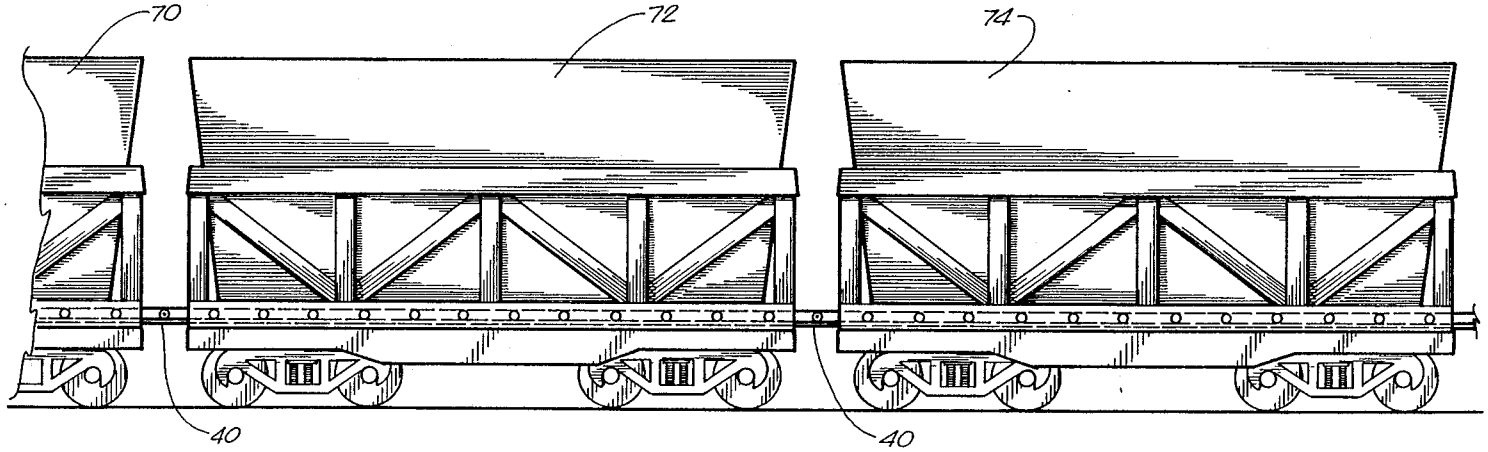
FIG. 8 is a side elevational view of the conveyor system as running below a plurality of hopper cars of the train.

FIG. 8 illustrates the train conveyor 40 as extending between a plurality of hopper cars 70, 72 and 74. In FIG. 8, the train conveyor 40 extends between and through each of the hopper cars of this unit train. Train conveyor 40 extends through the unit train to trailer car 15. The train conveyor 40 is a continuous belt throughout its travel through the train.

The present invention offers improved equipment and methods for the transport of bulk materials by rail, and for rapid and efficient unloading of bulk materials when a train arrives at its destination. A particular feature and advantage of the invention is that the equipment and method are functionally independent of any particular kind of unloading facility and independent of unloading time. The train can be unloaded by the train crew without the necessity for any unloading facilities or equipment or personnel at the unloading site.

Where aggregates are to be delivered to a highway construction site, for example, advantage may be taken of the fact that railroads frequently parallel highways; and the aggregates may be unloaded either or railroad right-of-ways or highway right-of-ways adjacent to the railroad and very close to the point of use of the aggregates. Additionally, such aggregates may be delivered to the site weeks, or even months, ahead of the time that the aggregates will be used by the highway contractor.

A unit train, as above-described, may be relatively small in terms of the number of hopper cars and overall train loads; and this may be desirable to enable the train to be a relatively low-powered locomotive. Where a large quantity of aggregates or materials are to be delivered to a particular destination, two or more such unit trains may be coupled together and either pulled by a larger locomotive or by multiple locomotives, one located at the front of the train and one located at the rear.

An important advantage of the invention is that such unit trains may be utilized to their maximum capacity since there is no need to remain at a site for several days or longer waiting to be unloaded. An ancillary advantage to the receiver of the materials is that he has much more flexibility in arranging for the transfer of the materials from the rail site to a storage or use location. He can schedule the use of his equipment much more efficiently, and need not be concerned about the cost of idle hopper cars sitting at a site.

Another feature and advantage of the invention is that several different kinds or grades of material can be shipped on the same train. Since the hoppers are unloaded sequentially, a first kind of material may be loaded onto the front portion of the train, a second kind of material may be loaded on a middle portion of the train, and a third kind of material may be loaded onto the rear portion of the train. If the train is unloaded in a window, the three different kinds of materials will be located in identifiable sections of the window. If the material is unloaded in piles by a portable stackable conveyor, by moving the conveyor or the train or both, the different kinds of material may be stacked in separate piles.

Another feature and advantage of the present invention is that the present invention is much more suitable for the transportation of materials that have accumulated an appreciable amount of moisture. These materials could include coal, crushed limestone, or sand; because of the steep walls of the hopper cars, the problems associated with bridging of the materials are eliminated. The steep angle of the hopper walls allow for free flow of such material and for expeditious unloading of such materials.

The present invention also offers the advantage of a much lower center of gravity for hopper cars under load. Railroads have a height limit for the center of gravity of mobile railroad equipment. Because the return idlers in the present invention are mounted on opposite sides of the center sill, the carrying surface of the return run of the conveyor belt may be only an inch or so above the top surface of the center sill. Because the troughing idlers are mounted in a catenary fashion in the present invention, the lowest point of the load-carrying belt may be as little as seven inches above the center sill of the hopper car. In addition, the hopper cars can be suitably lowered so that the center of gravity can be much lower than related designs. In addition, because the hopper walls are inclined at relatively shallow angles relative to the vertical, the center of gravity of the load carried by the hoppers will be much lower in the hopper structure.

Another aspect of the practical design of the equipment by the present invention is the inclusion of the trailer car, in association with a plurality of hopper cars, to carry substantially all of the auxiliary equipment associated with the unit train. This means, from the standpoint of manufacture, that all of the hopper cars may be standard and that the construction specification for all of the hopper cars may be the same. The present invention allows a practical system in which the train, consisting of a plurality of standard hopper cars, and a trailer car that provides for elevation of the discharging end of the train conveyor, a pivotal transfer conveyor that will enable discharge of the material at selected points either behind the trailer car or to either side of the trailer car, and the provision for power prime movers and systems for operating the conveyors and gates of the unit train.

An important advantage of the present invention is that it takes advantage of the efficiencies of rail transportation. It allows for twenty-four hour operation of the rail facilities and equipment while requiring no specialized unloading facility. An overall feature and advantage of the invention is that it provides for maximum economy in the business of transporting bulk materials since it utilizes the rail transportation to maximum advantage, utilizes the equipment to the fullest extent by eliminating idle time, and utilizes the crew more efficiently.

While the preferred embodiments of the invention have been illustrated and described it will be understood by those skilled in the art that changes and modifications may be resorted to without departing from the spirit and scope of the invention. The present invention should only be limited by the following claims and their legal equivalents.

I claim:

1. A self-unloading train for the transfer of bulk commodities comprising:

a plurality of hopper cars coupled together to form a train, each of said hopper cars including at least one hopper having side walls inclined at least seventy degrees from the horizontal and nearly vertical end walls, and a bottom discharge opening having a width of least fifty percent of a distance between wheels of said hopper cars to effect discharge of all material from said opening by gravity;

a train conveyor comprising an endless belt supported on said cars underlying said hopper discharge openings to receive material discharged therefrom and extending a length of said plurality of hopper cars, said train conveyor having a width greater than the width of said discharge openings; and gate means positioned at the discharge opening of said hoppers, said gate means being operable selectively to discharge material from said hopper onto said train conveyor.

2. A self-unloading as set forth in claim 1, said gate means comprising clam shell-type gates pivoted about axes parallel to said train conveyor to assist in controlling flow of material onto said train conveyor.

3. A self-unloading train as set forth in claim 1, said train including a trailer car, said train conveyor extending to said trailer car, and said trailer car supporting a lift portion of said train conveyor at a discharge end sufficiently high to discharge said material to a transfer conveyor.

4. A self-unloading train as set forth in claim 3, said transfer conveyor mounted on said trailer car for receiving material from said train conveyor and for discharging said material to selected points surrounding said trailer car.

5. A self-unloading train as set forth in claim 2, each of said clam shell-type gates being elongated, and having a long dimension parallel to said train conveyor less than a length of the top of said hopper.

6. A self-unloading train as set forth in claim 1, said discharge opening having a length comprising a substantial portion of a length of a top of said hopper.

7. A self-unloading train as set forth in claim 1, each of said hopper cars having a center sill, a return run of said conveyor belt being supported by split return idlers disposed alongside said center sill of said hopper cars, a supply run of said conveyor belt being supported by catenary troughing idlers disposed above said return run.

8. A self-unloading train as set forth in claim 4, further comprising:

drive means for said train conveyor and said transfer conveyor for providing motive power to said train conveyor and said transfer conveyor, said drive means being mounted on said trailer car.

9. A self-unloading train as set forth in claim 8, said drive means comprising an electric drive motor connected to said conveyors, a generator for providing electric power to said drive motor, and an internal combustion engine for driving said generator.

10. A self-unloading train as set forth in claim 1, said train conveyor including means for taking up slack thereof during conveyor operation and for introducing slack to said belt conveyor to allow said train to negotiate curves during transit.

11. A self-unloading train as set forth in claim 1, said gate means comprising:

hydraulic power means for operation of said gate means, said hydraulic power means connected to said gate means; and valving means for controlling opening and closing of said gate means, said valve means connected to said hydraulic power means.

12. A method of transporting bulk material by rail and unloading the same comprising the steps of:

loading bulk material having a particle size ratio of greater than 6 onto a train having a plurality of hopper cars, each having one or more hoppers, each of said hoppers having side walls inclined at least seventy degrees from the horizontal and nearly vertical end walls, said hoppers having a bottom discharge opening having a width at least fifty percent of a distance between wheels of said hopper cars:

transporting said bulk material to a remote location:

opening a discharge gate covering said bottom discharge opening such that said bulk material falls freely onto a train conveyor, said train conveyor underlying said hoppers and running a length of said hopper cars, said train conveyor having a width greater than the width of said discharge opening; and conveying said bulk material from said bottom discharge opening to a location distal from said hopper cars on said train conveyor; and discharging said bulk material from said train conveyor.

13. The method as set forth in claim 12, including the step of:

controlling the operation of said discharge gates sequentially with respect to said discharge openings of said hoppers. percent of a distance between wheels of said hopper cars to effect discharge of all material from said opening by gravity;

a train conveyor comprising an endless belt supported on said cars underlying said hopper discharge openings to receive material discharged therefrom and extending a length of said plurality of hopper cars, said train conveyor having a width greater than the width of said discharge openings; and gate means positioned at the discharge opening of said hoppers, said gate means being operable selectively to discharge material from said hopper onto said train conveyor.

14. The method as set forth in claim 12, further comprising the step of:

moving said train while discharging material from said train conveyor to produce a window of material paralleling a train track.

15. The method as set forth in claim 12, further comprising the step of:

discharging said bulk material from said train conveyor onto a stacking conveyor to produce a large pile of said bulk material distant from said train.

16. A hopper car for the transfer of bulk materials comprising:

a frame;

truck means mounted to said frame, said truck means for allowing movement along railroad tracks;

a plurality of hopper walls connected to said frame, said hopper walls being inclined at an angle of less than forty-five degrees to the vertical, said plurality of hopper walls defining a hopper discharge opening at the bottom of said walls;

said truck means comprising a plurality of wheels, said wheels positioned along opposite sides hopper car, said bottom discharge opening having a width at least fifty percent of a distance between said wheels on opposite sides of said hopper car;

gate means positioned at said hopper discharge opening, said gate means being operable selectively so as to allow the discharge of said bulk materials from within said hopper walls; and conveying means supported in catenary fashion to said frame and underlying said hopper discharge opening and for transferring said bulk materials distal of said hopper discharge opening, said gate means opening parallel to said conveyor means.

17. The hopper car of claim 16, said hopper walls being inclined at an angle of greater than seventy degrees from the horizontal.

18. The hopper car of claim 17, said plurality of hopper walls comprising:

a pair of side hopper walls inclined by at least seventy degrees from the horizontal; and a pair of end hopper walls inclined at a greater angle from the horizontal than said side hopper walls, said side hopper walls and said end hopper walls joined so as to form a generally rectangular configuration.

19. The hopper car of claim 16, said gate means comprising:

a clam shell-type gate pivotable about an axis parallel to a longitudinal axis of said hopper car, said clam shell-type gate for controlling flow of bulk material onto said conveyor means.

20. The hopper car of claim 19, said clam shell-type gate being elongated, said clam shell-type gate having a long dimension parallel to said train conveyor.

21. The hopper car of claim 20, said gate means further comprising:

a first clam shell-type gate rotatably mounted along one side of said hopper walls;

a second clam shell-type gate rotatably mounted along the opposite side of said hopper walls, said second claim shell-type gate in coordination with said first clam shell-type gate, said first clam shell-type gate and said second clam shell-type gate moving between a material retention position and a material discharge position; and hydraulic control means connected to said first clam shell-type gate and to said second clam shell-type gate, said hydraulic control means for actuating the movement of said first and second claim shell-type gates between said material retention position and said material discharge position.

22. The hopper car of claim 21, said hydraulic control means comprising:

a first double-acting hydraulic cylinder connected to said first clam shell-type gate;

a second double-acting hydraulic cylinder connected to said second clam shell-type gate; and a hydraulic control valve means hydraulically connected to said first and second double-acting hydraulic cylinders, said hydraulic control valve means for selectably actuating said first and second double-acting hydraulic cylinders.

23. The hopper car of claim 16, said discharge opening having a length greater than seventy percent of a length of a top of said hopper car.

24. A method of transporting bulk materials having a particle size ratio of greater than six, by a plurality of hopper cars on a rail system, said hopper cars having walls inclined at an angle greater than seventy degrees from the horizontal, said hopper cars having a bottom discharge opening with a width at least fifty percent of a distance between wheels of said hopper cars, said hopper cars having a tensionable conveyor system underlying said bottom discharge opening, said method comprising the steps of:

loading bulk material onto a train having said plurality of hopper cars, said loading occurring at a supply location;

removing a portion of the tension in said conveyor system;

moving said loaded bulk material along said rail system from said said supply location to a discharge location;

tensioning said conveyor system so as to remove slack in a conveyor belt within said conveyor system;

actuating said conveyor system such that said conveyor belt moves longitudinally beneath said bottom discharge openings of said hopper cars;

opening a discharge gate associated with said bottom discharge opening such that said bulk material drops through said bottom discharge opening onto said conveyor system; and directing said bulk material by said conveyor system to a desired discharge location.

25. The method of claim 24, said step of opening said discharge gate comprising the step of:

opening a plurality of discharge gates sequentially with respect to said bottom discharge openings of said hopper cars.

26. The method of claim 24, said method further comprising:

coupling an end car to said hopper cars prior to the step of opening said discharge gate, said end car having a transfer conveyor connected thereto.

27. The method of claim 26, said step of directing said bulk material comprising:

conveying said bulk material to said end car by means of said conveyor system; and conveying said bulk material by said transfer conveyor to selected points relative to said end car.

* * * * *